US007855519B2

(12) United States Patent
Cho

(10) Patent No.: US 7,855,519 B2
(45) Date of Patent: Dec. 21, 2010

(54) METHOD FOR DRIVING OF A FLUORESCENT LIGHTING AND A BALLAST STABILIZER CIRCUIT FOR PERFORMING THE SAME

(75) Inventor: Young-Chang Cho, Cheongju (KR)

(73) Assignee: Ace Electro Tech Corp., Jincheon-Kun (KR)

( * ) Notice: Subject to any disclaimer, the term of this patent is extended or adjusted under 35 U.S.C. 154(b) by 268 days.

(21) Appl. No.: 11/596,698

(22) PCT Filed: Jun. 10, 2005

(86) PCT No.: PCT/KR2005/001769

§ 371 (c)(1),
(2), (4) Date: Aug. 12, 2008

(87) PCT Pub. No.: WO2006/054820

PCT Pub. Date: May 26, 2006

(65) Prior Publication Data

US 2008/0303455 A1 Dec. 11, 2008

(30) Foreign Application Priority Data

Nov. 16, 2004 (KR) ..... 10-2004-0093579

(51) Int. Cl.
*H05B 41/06* (2006.01)

(52) U.S. Cl. ..... 315/307

(58) Field of Classification Search ..... 315/200 R, 315/307, 291, 209 R, 7
See application file for complete search history.

(56) References Cited

U.S. PATENT DOCUMENTS

| | | | | |
|---|---|---|---|---|
| 3,821,509 | A * | 6/1974 | Amagami et al. | 219/668 |
| 5,416,387 | A * | 5/1995 | Cuk et al. | 315/209 R |
| 5,500,576 | A | 3/1996 | Russell et al. | |
| 5,841,241 | A | 11/1998 | Nilssen | |
| 6,285,138 | B1 * | 9/2001 | Kataoka et al. | 315/291 |
| 7,592,753 | B2 * | 9/2009 | Baarman et al. | 315/274 |
| 2004/0125071 | A1 * | 7/2004 | Kim et al. | 345/102 |

* cited by examiner

*Primary Examiner*—Douglas W Owens
*Assistant Examiner*—Minh D A
(74) *Attorney, Agent, or Firm*—Greer, Burns & Crain, Ltd.

(57) ABSTRACT

A method of driving a fluorescent light, having: (a) receiving and full-wave rectifying commercial AC power; (b) dividing phases of the AC power full-wave rectified at step (a) depending on voltage magnitude, and performing switching control such that low-voltage portions of the divided voltages, having low phases, are used as heating power for heating filaments of a fluorescent tube, and high-voltage portions of the divided voltages, having high phases, are used as discharge voltage of the fluorescent tube; (c) switching on the low-voltage portions having low phases as the heating power for heating the filaments of the fluorescent tube in response to a signal output at step (b); and (d) switching on the high-voltage portions having high phases as the lighting power of the fluorescent tube in response to the signal output at step (b).

5 Claims, 3 Drawing Sheets

[Fig. 1]
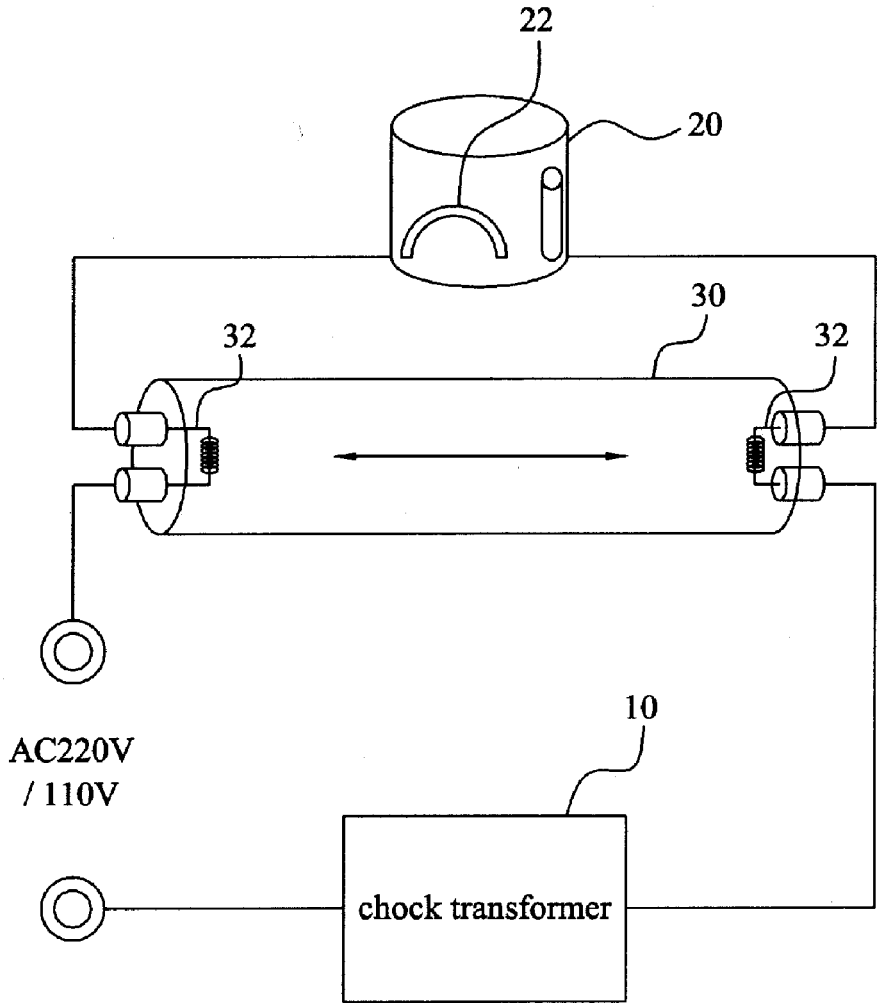
[Fig. 2]
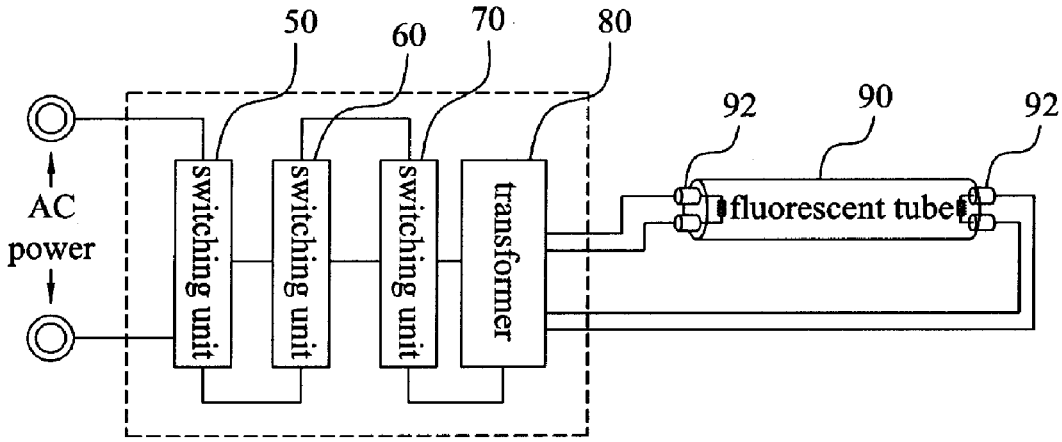

[Fig. 3]
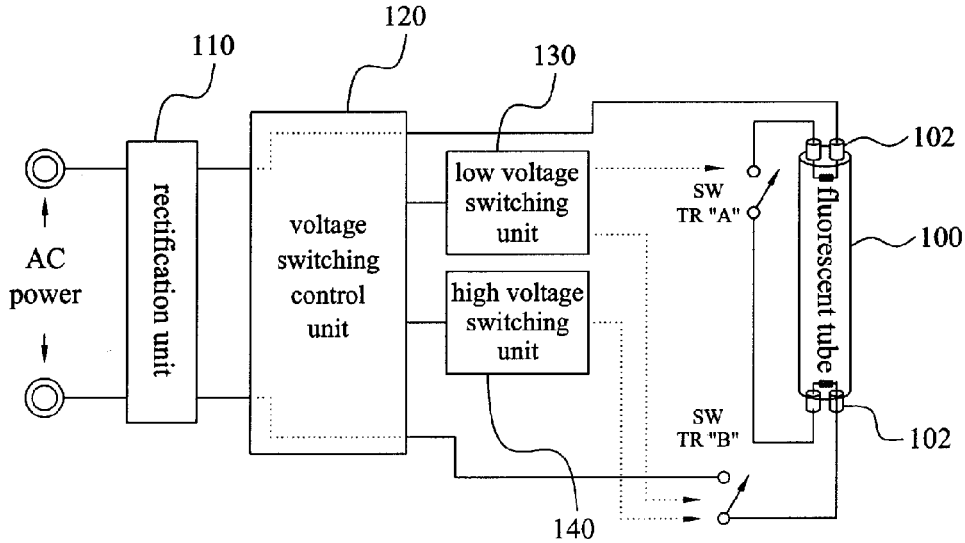
[Fig. 4]
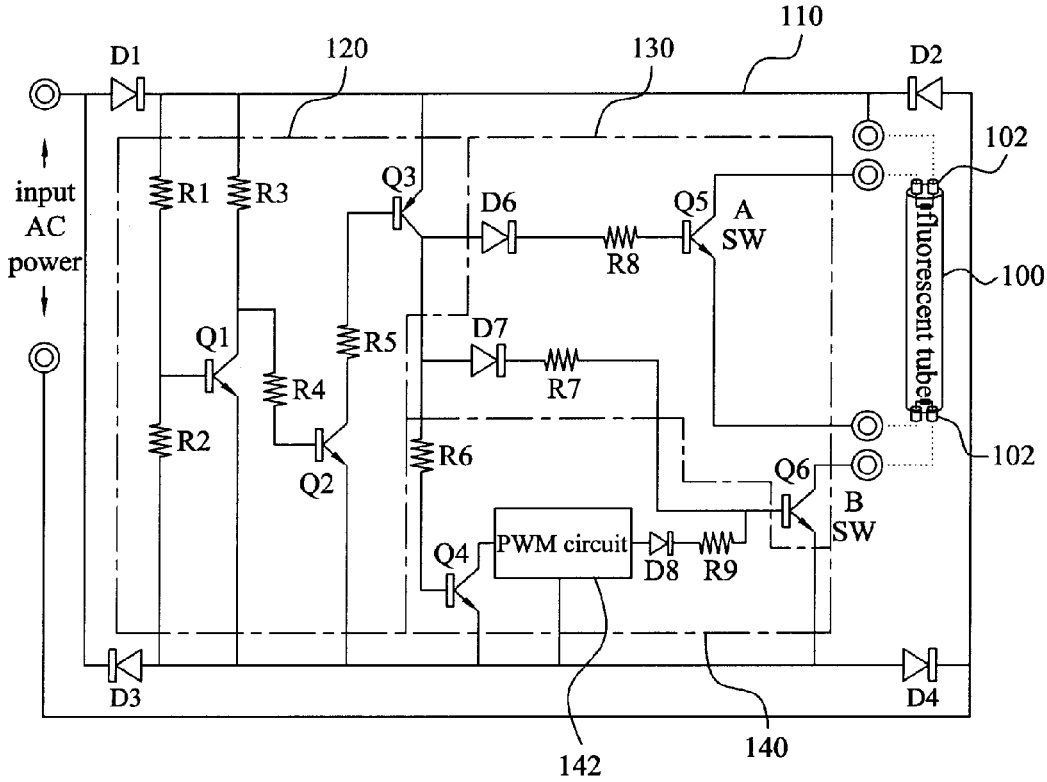

[Fig. 5]
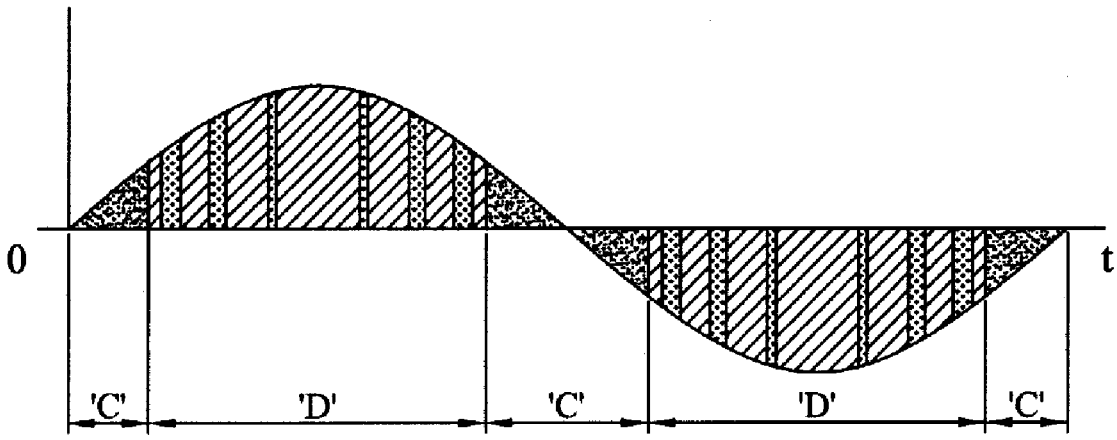

METHOD FOR DRIVING OF A FLUORESCENT LIGHTING AND A BALLAST STABILIZER CIRCUIT FOR PERFORMING THE SAME

TECHNICAL FIELD

The present invention relates to a method of driving a fluorescent light and a ballast stabilizer circuit for performing the same, and, more particularly, to a method of driving a fluorescent light which divides the phases of input AC power depending on voltage magnitude and utilizes the low-voltage portions of the divided voltages as heating power for heating filaments and the high-voltage portions of the divided voltages as the discharge voltage of the fluorescent tube in a heat and discharge type fluorescent light, thus lengthening the lifetime of the fluorescent light, improving the illuminance of a fluorescent tube, and improving the efficiency of power use due to the elimination of need for power transformation, and a ballast stabilizer circuit for performing the same.

BACKGROUND ART

Generally, a fluorescent light is the most commonly used lighting equipment in a home or an office because it has low power consumption and very high brightness, compared to a general incandescent lamp. A fluorescent light is a type of discharge lamp. When electric discharges are generated by applying high voltage to the electrodes (filaments) of the fluorescent tube of a fluorescent light, a large number of electrons are emitted and absorbed by fluorescent material applied to the inner surface of the fluorescent tube, so that the fluorescent material emits light, thereby exhibiting the inherent brightness of the fluorescent light.

A general preheating type fluorescent light, as illustrated in FIG. 1, includes a choke transformer 10, a glow start lamp (hereinafter starter lamp) 20, and a fluorescent tube 30. Filaments 32, that is, the electrodes of the fluorescent tube 30, are coated with electron emission material, and must be heated until the electron emission material is activated. When a power switch is turned on, the starter lamp 20 preheats the filaments until the tube emits light due to electric discharges, so that the fluorescent light is turned on. The choke transformer 10 is a device for generating high voltage required for electric discharges.

In a general method of turning on a fluorescent light, when a user turns on a light switch, one of the power supply lines is connected to the starter lamp 20 through the choke transformer 10, and the other of the power supply lines is connected to the starter lamp 20 through the filaments 32 formed in both sides of the fluorescent tube 30, so that voltage is applied to both sides of the starter lamp 20 at the time of applying the voltage. When the voltage is applied to the starter lamp 20, the starter lamp 20 is turned on. At this time, a bimetal lead 22, which is formed inside the starter lamp 20, is physically deformed due to heat generated by the turning on of the starter lamp 20, so that both sides of the starter lamp 20 are short-circuited. When both sides of the starter lamp 20 are short-circuited, voltage is applied to the filaments of both sides of the fluorescent tube 30 via the chock transformer 10. When the voltage is applied to both sides of the fluorescent tube 30, the filaments formed in both sides of the fluorescent tube 30 are heated. Therefore, as the power supplied to the starter lamp 20 decreases, the starter lamp 20 ceases to generate discharges and is turned off. Due to the turning off of the starter lamp 20, the heating of filaments is stopped and, therefore, the bimetal lead 22 formed inside the starter lamp 20 is deformed, so that both sides of the starter lamp 20 are disconnected from each other from a circuit viewpoint. When both sides of the starter lamp 20 are disconnected from each other from a circuit viewpoint, the supply of current to the starter lamp 20 through the filaments 32 is stopped, so that high voltage is induced between the two filaments 32. The fluorescent tube 30 starts to generate discharges due to the voltage induced between two filaments 32 of the fluorescent tube 30, and a large number of electrons are then emitted. When the electrons are absorbed by fluorescent material applied to the inner surface of the fluorescent tube, the fluorescent tube 30 emits light.

When the fluorescent tube 30 emits light, the power that is supplied to the starter lamp 20 decreases and then the starter lamp 20 does not generate discharges, thereby maintaining its initial state.

The method of turning on a fluorescent light using the discharge-type starter lamp 20 has disadvantages in that the operation of the starter lamp varies depending on temperature variation and input voltage, the lifetime of the fluorescent tube 30 is shortened due to the unstable supply of power that is caused by unstable operation attributable to the difference between the product qualities of a starter lamp and the period of use of the starter lamp, and the efficiency of power use decreases due to the use of the method of converting voltage using the choke transformer 10.

In order to resolve the above-described problems, an electronic ballast stabilizer composed of an electric circuit was invented. As illustrated in FIG. 2, the electronic ballast stabilizer converts AC power received from a rectification unit 50 into DC power, oscillates the converted DC power at 30 KHz~100 KHz through an oscillation unit 60, and switches the oscillated DC power to the primary coil of a transformer 80 for transforming voltage using a switching unit 70. The secondary coil of the transformer 80 generates discharges by applying current-limited high voltage to both sides of a fluorescent tube 90, while heating the filaments of the fluorescent tube 90 using the voltage induced from the primary coil, thereby turning on the fluorescent tube 90.

The above-described electronic ballast stabilizer uses power transformation and switching. The electronic ballast stabilizer has superior power efficiency compared to the method using a discharge type starter lamp. However, there are disadvantages in that power efficiency still decreases due to the power transformation, the components of a switching unit are expensive, the components emit a large amount of heat, and the miniaturization of the components is difficult, so that the miniaturization of a ballast stabilizer circuit is not easy, thereby increasing manufacturing cost and therefore causing low economic efficiency.

DISCLOSURE OF INVENTION

Technical Problem

Accordingly, the present invention has been made keeping in mind the above problems occurring in the prior art, and a first object of the present invention is to provide a method of driving a fluorescent light which divides the phases of input AC power depending on voltage magnitude and utilizes the low-voltage portions of the divided voltages as heating power for heating filaments and the high-voltage portions of the divided voltages as the discharge voltage of the fluorescent tube, thus lengthening the lifetime of the fluorescent light, improving the illuminance of a fluorescent tube, and improving the efficiency of power use due to the elimination of need for power transformation.

A second object of the present invention is to provide a ballast stabilizer circuit for performing the method.

Technical Solution

In order to accomplish the first object, the present invention includes the steps of receiving and full-wave rectifying commercial AC power; dividing the phases of the full-wave rectified AC power depending on voltage magnitude, and performing switching control such that low-voltage portions of the divided voltages having low phases are directly used as heating power for heating filaments of a fluorescent tube without voltage transformation, and high-voltage portions of the divided voltages having high phases are directly used as discharge voltage of the fluorescent tube without voltage transformation; switching on the low-voltage portions having low phases as heating power for heating the filaments of the fluorescent tube; and switching on the high-voltage portions having high phases as lighting power of the fluorescent tube.

Furthermore, in order to accomplish the first object, the present invention includes a rectification unit configured to include diodes D1 to D4 and full-wave rectify input commercial AC power; a voltage switching control unit configured to receive the AC power full-wave rectified by the rectification unit, divide the magnitudes of the AC power depending on phases of voltage, and perform switching control such that low-voltage portions of the divided voltages having low phases are used as heating power for heating filaments of a fluorescent tube, and high-voltage portions of the divided voltages having high phases are used as discharge voltage of the fluorescent tube; a low-voltage switching unit connected to output of the voltage switching control unit, and configured to switch on and off the heating power for heating the filaments of the fluorescent tube in response to an output signal of the voltage switching control unit; and a high-voltage switching unit connected to an output of the voltage switching control unit and configured to form a Pulse-Width-Modulation (PWM) circuit for pulse-width-modulating the high-voltage portions and then applying the lighting power of the fluorescent tube, thereby switching on power for discharge of the fluorescent tube in response to the output signal of the voltage switching control unit.

The present invention is composed of only transistors and resistors for low power, so that circuit integration is possible.

BRIEF DESCRIPTION OF THE DRAWINGS

FIG. 1 is a construction diagram illustrating a method of turning on a general fluorescent light;

FIG. 2 is a diagram illustrating the operation of a general ballast stabilizer;

FIG. 3 is a block diagram illustrating a method of driving a fluorescent light according to the present invention;

FIG. 4 is a circuit diagram illustrating the construction and operation the ballast stabilizer circuit of the fluorescent light according to an embodiment of the present invention; and FIG. 5 is a waveform diagram illustrating the operation waveform of the ballast stabilizer circuit of the fluorescent light according to the present invention.

BEST MODE FOR CARRYING OUT THE INVENTION

Preferred embodiments of the present invention are described in below with reference to the accompanying drawings.

FIG. 3 is a diagram illustrating a method of driving a fluorescent light according to the present invention, FIG. 4 is a circuit diagram illustrating the construction and operation of the ballast stabilizer circuit of a fluorescent light according to an embodiment of the present invention, and FIG. 5 is a waveform diagram illustrating the operation waveform of the ballast stabilizer circuit of the fluorescent light.

The method of driving the fluorescent light according to the present invention employs a method of directly supplying Alternating Current (AC) power, so that power loss due to voltage transformation is prevented by eliminating the voltage transformation of AC power, unlike a conventional electronic ballast stabilizer using an electronic circuit. That is, as illustrated in FIG. 3, a rectification unit 110 including diodes D1 to D4, full-wave rectifies commercial AC power applied from a power supply unit. A voltage switching control unit 120, which divides the phases of the AC power, which is full-wave rectified by the rectification unit 110, depending on voltage magnitude, and then performs switching control such that the low-voltage portions of the divided voltages having low phases are used as heating power for heating the filaments 102 of the fluorescent tube 100, and the high-voltage portions of the divided voltages having high phases are used as the discharge voltage of the fluorescent tube 100, is formed on the output side of the rectification unit 110.

A low-voltage switching unit 130, which switches on and off the heating power for heating the filaments 102 of the fluorescent tube 100 in response to the output signal of the voltage switching control unit 120, and a high-voltage switching unit 140, which switches on and off the power for discharges in the fluorescent tube 100 in response to the output signal of the voltage switching control unit 120, are formed on the output side of the voltage switching control unit 120.

In this case, the high-voltage switching unit 140 includes a Pulse Width Modulation (PWM) circuit 142 which pulse-width-modulates the high-voltage portions and then supplies appropriate power for the application of lighting power of the fluorescent tube 100 after the fluorescent tube 100 has been turned on.

In the method of driving the fluorescent light according to the present invention, a negative feedback circuit (not shown) which detects the amount of discharge of the fluorescent tube 100, is further formed in the high-voltage switching unit 140, so that brightness is adjusted to a constant output by detecting the amount of discharge of the fluorescent tube 100 and controlling output power depending on the detected amount of discharge, and the magnitude of the heating power applied to the filaments 102 is controlled by controlling the low-voltage switching unit 130.

In the above-described method of driving the fluorescent light according to the present invention, commercial AC power of 110V or 220V is input, the AC power is full-wave rectified by the rectification unit 110, and switching is controlled such that the full-wave rectified waveform (ripple waveform) is divided into high-voltage portions of a voltage waveform having high phases and low-voltages portions of the voltage waveform having low phases through the voltage switching control unit 120.

That is, as illustrated in the waveform diagram of the FIG. 5, the voltage switching control unit 120 operates the low-voltage switching unit 130 during the time in which the low-voltage portions of the voltage phases of the applied AC power, that is, portions C, are applied, thus turning on switches A and B and then switching on the heating power for heating the filaments 102 located in both sides of the fluorescent tube 100.

The voltage switching control unit 120 operates the high-voltage switching unit 140 during the time in which the high-voltage portions of the voltage phases of the applied AC power in the waveform diagram of FIG. 5, that is, portions D, are applied, so that a switching pulse is applied to the PWM circuit 142, thus turning on the fluorescent tube 100.

That is, the method of driving the fluorescent light according to the present invention divides the phases of input commercial AC power into high-phase voltage (high voltage) portions and low-phase voltage (low voltage) portions, uses the low-voltage portions, that is, portions C, to heat the filaments 102 of the fluorescent tube 100, and uses the high-voltage portions, that is, portions D, as the lighting power for turning on the fluorescent tube 100, so that the AC power is directly supplied through a direct switching operation without the transformation of the AC power, thereby removing the cause of power loss and improving the efficiency of power use.

The method of driving the fluorescent light according to the present invention can be implemented using the ballast stabilizer circuit of FIG. 4. The construction and operation of FIG. 4 are described. When commercial AC power is applied, the rectification unit 110, including diodes D1 to D4, full-wave rectifies the applied commercial AC power, and supplies the full-wave rectified waveform (ripple waveform) to a circuit. The voltage switching control unit 120 is formed inside the rectification unit 110 including four diodes D1 to D4. In the voltage switching control unit 120 inside the rectification unit 110 including four diodes D1 to D4, resistors R1 and R2, which divide the full-wave rectified power based on resistance ratio, connects in series to each other, and a line branches off between the resistors R1 and R2 and connects to the base terminal of a first transistor Q1. The collector terminal of the first transistor Q1 is connected to the rectification unit 110 via a resistor R3, and the emitter terminal of the first transistor Q1 is also connected to the rectification unit 110. The collector terminal of the first transistor Q1 is connected to the base terminal of a second transistor Q2 via a resistor R4. The collector terminal of the second transistor Q2 is connected to the base terminal of a third transistor Q3, and the emitter terminal of the second transistor Q2 is connected to the rectification unit 110.

The low-voltage switching unit 130 and the high-voltage switching unit 140 are connected to the collector terminal of the third transistor Q3 of the voltage switching control unit 120. The low-voltage switching unit 130 is formed using a fifth transistor Q5 and a sixth transistor Q6 that are connected at the base terminals thereof to the collector terminal of the third transistor Q3 via diodes D6 and D7 and resistors R7 and R8, and switch on and off the heating power for heating the filaments 102 of the fluorescent tube 100.

Furthermore, the high-voltage switching unit 140 includes a fourth transistor Q4 connected at the base terminal thereof to the collector terminal of the third transistor Q3 of the voltage switching control unit 120 via a resistor R6, and the PWM circuit 142 connected to the collector terminal of the fourth transistor Q4 and configured to pulse-width modulate input power in response to the operation of the fourth transistor Q4, and apply the lighting power of the fluorescent tube 100. The PWM circuit 142 has a typical construction, so that illustration and description thereof are omitted.

In the operation of the above-described ballast stabilizer circuit for performing the method of driving the fluorescent light according to the present invention, input commercial AC power is full-wave rectified by the four diodes D1 to D4 that constitute the rectification unit 110. The full-wave rectified power voltage is divided based on the resistance ratio of the resistors R1 and R2 of the voltage switching control unit 120, which are connected in series to each other and the phases of the power voltage.

As illustrated in FIG. 5, the phases of the power voltage full-wave rectified by the rectification unit 110 continuously varies along a time axis. The resistors R1 and R2 of the voltage switching control unit 120 divide the phases of the commercial AC power into high-phase voltages (high voltage) portions and low-phase voltage (low voltage) portions based on the resistance ratio thereof. That is, The resistors R1 and R2 of the voltage switching control unit 120 turns on the first transistor Q1 only during the time in which the magnitude of the phases of power, which is full-wave rectified based on the resistance ratio, exceeds a predetermined voltage value.

Therefore, as illustrated in FIG. 5, in portions C, that is, the low-voltage portions in which the phases of the full-wave rectified power are less than the predetermined voltage value, the first transistor Q1 of the voltage switching control unit 120 is turned off, so that the power is applied to the base terminal of the second transistor Q2 via resistors R3 and R4, thereby turning on the second transistor Q2. Furthermore, the power is applied to the base terminal of the third transistor Q3 via the resistor R5, thereby turning on the third transistor Q3. As a result, the power is applied to the base terminals of the fifth and sixth transistors Q5 and Q6 via diodes D6 and D7, thereby turning on the fifth and sixth transistors Q5 and Q6, so that the low-phase voltage of the full-wave rectified power is applied to the filaments 102 in both sides of the fluorescent tube 100 to heat the filaments 102 of the fluorescent tube 100.

At this time, the power is also applied to the base terminal of the fourth transistor Q4, which constitutes the high-voltage switching unit 140, thereby turning on the fourth transistor Q4. Therefore, a switching pulse is not applied to the PWM circuit 142 that applies the lighting power of the fluorescent tube 100, so that only the low-voltage portions having low phases are applied to the fluorescent tube 100 as the heating power of the filaments 102.

After a predetermined time, as illustrated in FIG. 5, during portions D, that is, the high-voltage portions, in which the phases of the full-wave rectified power are greater than the predetermined voltage value, the first transistor Q1 of the voltage switching control unit 120 is turned on, so that the second transistor Q2 and the third transistor Q3 are turned off. Therefore, the fifth and sixth transistors Q5 and Q6, which constitute the low-voltage switching unit 130, are turned off, so that the low-voltage switching unit 130 does not operate. Furthermore, the fourth transistor Q4, which constitutes the high-voltage switching unit 140, is turned off, so that the switching pulse is applied to the PWM circuit 142 that applies the lighting power of the fluorescent tube 100. Thereafter, the signal, which is pulse-width modulated by the PWM circuit 142, is applied to the base terminal of the sixth transistor Q6 via the resistor R6, so that the pulse-width modulated high voltage is applied to both sides of the fluorescent tube 100 and used as the lighting power of the fluorescent tube 100.

In the ballast stabilizer circuit according to the present invention, it is preferred to construct a negative feedback circuit by dividing the sixth transistor Q6 into two transistors (not shown), one transistor of which switches on and off power for heating the filaments of the fluorescent tube 100, and the other transistor of which switches on and off the high voltage for the turning on of the fluorescent tube 100, and by including a resistor (not shown) at the emitter terminal of the other transistor that switches on and off the high voltage for the turning on of fluorescent tube 100, thereby detecting current flowing through the resistor, and then decreasing the power applied to the one transistor that switches on and off the power for heating the filaments 102, when the other transistor, which switches on and off the high voltage for the turning on of the fluorescent tube 100, operates, and then the turning on by the high voltage is performed.

The method of driving the fluorescent light according to the present invention performs control such that the filaments 102 of the fluorescent tube 100 are heated as required by applying the low-voltage portions at the time of initial discharge thereof, and, after the start of discharge, are heated minimally to help the emission of heat electrons.

INDUSTRIAL APPLICABILITY

As described above, the present invention divides the phases of input AC power depending on voltage magnitude and utilizes the low-voltage portions of the divided voltages as heating power for heating filaments and the high-voltage portions of the divided voltages as the discharge voltage of the fluorescent tube, thus lengthening the lifetime of the fluorescent light, improving the illuminance of the fluorescent tube, and improving the efficiency of power use due to the elimination of need for power transformation.

Although the preferred embodiments of the present invention have been described in detail with reference to the accompanying drawings, the present invention is not limited to this embodiments and the amendment and modification thereof are possible by those skilled in the art.

The invention claimed is:

1. A ballast stabilizer circuit, comprising:

a rectification unit configured to include diodes and full-wave rectify input commercial AC power;

a voltage switching control unit configured to receive the AC power full-wave rectified by the rectification unit, divide magnitudes of the AC power depending on phases of voltage, and perform switching control such that low-voltage portions of the divided voltages, having low phases, are used as heating power for heating filaments of a fluorescent tube, and high-voltage portions of the divided voltages, having high phases, are used as discharge voltage of the fluorescent tube;

a low-voltage switching unit connected to an output of the voltage switching control unit, and configured to switch on and off the heating power for heating the filaments of the fluorescent tube in response to an output signal of the voltage switching control unit;

and a high-voltage switching unit connected to the output of the voltage switching control unit and configured to form a Pulse-Width-Modulation (PWM) circuit for pulse-width-modulating the high-voltage portions and then applying the lighting power of the fluorescent tube, thereby switching on power for discharge of the fluorescent tube in response to the output signal of the voltage switching control unit, wherein the voltage switching control unit comprises, inside the rectification unit:

resistors connected in series and configured to divide voltage magnitude according to phases of the full-wave rectified power based on resistance ratio;

a first transistor connected between the resistors at base terminal thereof and connected at a collector terminal to the rectification unit via a resistor, and at an emitter terminal thereof to the rectification unit;

a second transistor connected at a base terminal thereof to the collector terminal of the first transistor via resistors, and at an emitter terminal thereof to the rectification unit; and a third transistor connected at a base terminal thereof to the collector terminal of the second transistor, and at a collector terminal thereof to the low-voltage switching unit and the high-voltage switching unit.

2. The ballast stabilizer circuit as set forth in claim 1, further comprising a negative feedback circuit located on an output side of the high-voltage switching unit, and configured to adjust brightness to a constant output by detecting an amount of discharge of the fluorescent tube and controlling output power depending on the detected amount of discharge, and to control a magnitude of the heating power applied to the filaments by controlling the low-voltage switching unit.

3. The ballast stabilizer circuit as set forth in claim 2, wherein the negative feedback circuit is constructed by dividing the sixth transistor into two separated transistors, one transistor of which switches on and off power for heating the filaments of the fluorescent tube, and a remaining transistor of which switches on and off the high voltage for the turning on of the fluorescent tube, and includes a resistor at the emitter terminal of the remaining transistor that switches on and off the high voltage for the turning on of fluorescent tube, thereby detecting current flowing through the resistor, and then decreasing the power applied to the one transistor that switches on and off the power for heating the filaments, when the fluorescent tube is turned on.

4. The ballast stabilizer circuit as set forth in claim 1, wherein the low-voltage switching unit comprises a fifth transistor and a sixth transistor that are connected at base terminals thereof to the collector terminal of the third transistor via diodes and resistors and switch on and off the heating power for heating the filament of the fluorescent tube.

5. The ballast stabilizer circuit as set forth in claim 1, wherein the high-voltage switching unit comprises a fourth transistor connected at a base terminal thereof to the collector terminal of the third transistor of the voltage switching control unit via a resistor, and the PWM circuit connected to the collector terminal of the fourth transistor and configured to pulse-width modulates input power in response to the operation of the fourth transistor and apply lighting power of the fluorescent tube.

* * * * *